United States Patent [19]

Coler

[11] 3,972,102

[45] Aug. 3, 1976

[54] MEANS FOR MAKING AN ELECTRICAL CONNECTOR

[75] Inventor: Benjamin W. Coler, Littleton, Colo.

[73] Assignee: Honeywell Inc., Minneapolis, Minn.

[22] Filed: May 12, 1975

[21] Appl. No.: 576,637

[52] U.S. Cl. ..... 29/206 D; 29/203 D; 29/203 H; 72/391; 339/252 R

[51] Int. Cl.[2] ..... H01R 43/00

[58] Field of Search ..... 29/206, 203 D, 203 DT, 29/203 H, 203 HT, 203 HM, 203 P; 339/252 R; 72/391

[56] References Cited

UNITED STATES PATENTS

| | | | |
|---|---|---|---|
| 3,295,097 | 12/1966 | Van Horssen et al. | 339/252 R X |
| 3,605,236 | 9/1971 | Bouckaert | 29/203 H |
| 3,807,010 | 4/1974 | Semrad | 29/206 |

*Primary Examiner*—Carl E. Hall

*Attorney, Agent, or Firm*—Henry L. Hanson; Charles J. Ungemach; David R. Fairbairn

[57] ABSTRACT

A means for bending an outer end portion of a center pin comprises a jig having a sleeve-shaped fixture which may be inserted into the inner wall of a cup-shaped member surrounding the center pin. A restricted or inturned end portion of the fixture thereupon embraces the outer end portion of the center pin. A cylindrical ram having a tapered end is inserted through the open end of the sleeve-shaped fixture to engage and bend the free end of the pin which extends into the restricted end portion of the fixture.

3 Claims, 4 Drawing Figures

MEANS FOR MAKING AN ELECTRICAL CONNECTOR

CROSS REFERENCE TO RELATED APPLICATIONS

Subject matter shown and described but not claimed herein is shown, described and claimed in a copending application of Dean M. Peterson filed on even date herewith.

BACKGROUND OF THE INVENTION

1. Field of the Invention

The present invention relates to an improved electrical connector of the type known as P.C. connectors. The improved connector is particularly useful for providing a good mating contact between small electrical connections such as those used for coupling hand-held cameras to suitable flash devices.

2. Description of the Prior Art

A standard coaxial connector for camera equipment includes a jack, socket or receptacle comprising an inner and an outer sleeve contact coaxially positioned and insulated from each other. A complementary plug for the connector includes an outer cylindrical sleeve and a central pin. Again, the pin is coaxially positioned with respect to and insulated from the sleeve. Such connectors are known in the art as P.C. connectors.

It has been found that, because of the very small dimensions of such connectors, due to wear and strain, or loose tolerances, an unreliable contact is established between th plug pin and the inner sleeve of the jack. Such unreliable contacts often result in a failure of a flash unit to fire when it should, causing a loss of a picture.

In an effort to overcome that deficiency, the pin has heretofore been positioned slightly eccentrically with respect to the outer sleeve of the plug. It has been found that that attempted solution produced a shear strain on the insulator holding the pin in place, resulting in a cold-flow of the plastic insulator, again allowing the unreliability element to reappear.

SUMMARY OF THE INVENTION

It is, accordingly, an object of the present invention to provide an improved connector which obviates the noted shortcomings of the known prior art.

It is another object of the present invention to provide an improved connector suitable for use in electrically coupling a camera to a flash unit.

It is a further object of the present invention to provide a means of making an improved connector as set forth.

In accomplishing these and other objects, there has been provided, in accordance with the present invention, a connector of the type known in the art as a P.C. connector in which the jack, socket or receptacle is conventional and in which the plug is modified from the conventional in that the central pin is given a predetermined bend or curvature. That bent pin assures that, when the plug is inserted in the conventional jack, a good, reliable electrical contact will be established.

Inasmuch as the central pin of such P.C. connectors are relatively small, a special jig has been provided to effect the bending of the pin. The jig includes an outer holding sleeve for stabilizing the pin at a longitudinally intermediate position, and a plunger or ram movable within the holding sleeve to effect a bending of the free end of the pin.

BRIEF DESCRIPTION OF THE DRAWINGS

A better understanding of the present invention may be had when the following detailed description is read in connection with the accompanying drawings in which.

DETAILED DESCRIPTION

Figure 1:
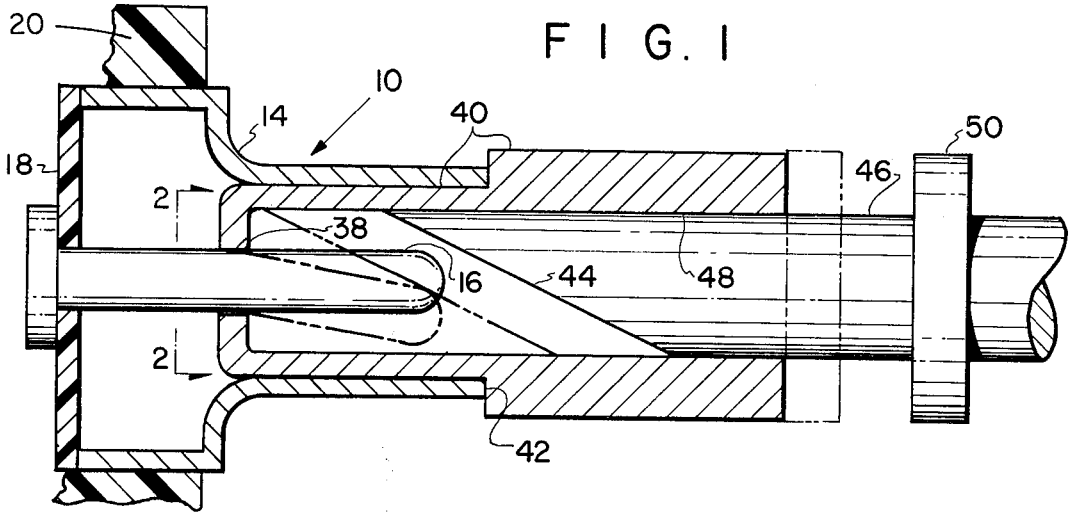
FIG. 1 is an illustration of a P.C. plug embodying the present invention, as well as a jig for effecting the desired result.
Figure 2:
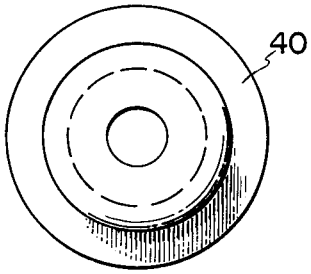
FIG. 2 is an end view of the fixture per se taken along the lines 2—2 of FIG. 1 and viewed in the direction of the arrows.
Figure 3:
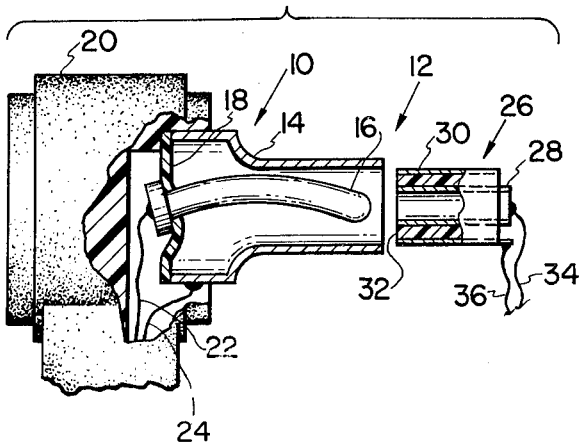
FIG. 3 is a view of the bent center pin and a socket portion of the P.C. jack.
Figure 4:
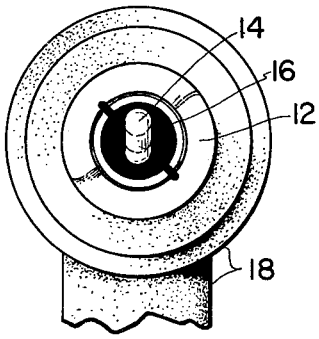
FIG. 4 is an end view of the plug portion of the P.C. connector as shown in FIG. 3.

There is shown in FIG. 1 an enlarged cross-sectional view of a plug portion 10 of a so-called P.C. connector 12 (FIG. 3). The plug includes an outer sleeve conductor 14 and a central pin conductor 16. A base member 18 of insulating material, such as a suitable plastic material, supports the central pin 16 in substantially coaxial relationship with the outer sleeve conductor 14.

The outer sleeve conductor 14 is mounted in a hollow housing 20 that is made of semi-rigid, plastic insulating material as illustrated in FIG. 3.

The hollow housing 20 is broken away to illustrate how associated separate electrical conductor or lead wires 22, 24 are connected to and extend away from the conductive sleeve conductor 14 and away from the fixed end of the conductive pin 16.

FIG. 3 also shows a socket 26 having an inner and outer conductive sleeve 28, 30 separated by a ring of insulating material 32. A pair of electrically conductive wires 34, 36 are electrically connected to and extend away from the remote end of each of the sleeve 28, 30. In a conventional arrangement, the socket 26 is mounted in the body of a camera or the like with the open end of the socket slightly recessed below the surface of the camera body, the remote end of the socket being firmly secured within the camera body.

FIG. 1 illustrates the manner in which the center pin 16 of this invention is bent to the position as shown in FIG. 3. The bored out wall 38 of a sleeve-shaped fixture 40 is shown mounted on an outer free end portion of the center pin 16. The shoulder 42 of the fixture 40 is shown in engagement with the right end of the cylindrical shaped cup 14 of the P.C. connector 12.

The tapered end 44 of a cylindrically shaped tool 46, shown in dot dash line form, is mounted within the inner cylindrical wall surface 48 of the fixture 40. The tapered end 44 of tool 46 is in physical engagement with the center pin 16 at one end and an opposite stop end portion 50 of the tool 46 is shown in contact with the right end of the fixture 40.

MODE OF OPERATION

The longitudinal centerline of the socket 26 is in alignment with the longitudinal centerline of the center pin 16 before the bending of the pin 16 from its solid to its dot dash line position occurs as is shown in FIG. 1.

As illustrated in FIG. 1, the first step used in making the bent center pin 16 of this invention, as shown in FIG. 3, is to slide the bored out wall 38 of a sleeve-shaped fixture 40 along an outer free end portion of the center pin 16 until the shoulder 42 of the fixture 40 contacts the right end of the cylindrical shaped cup 14 of the P.C. plug 12.

The second, or center pin bending step is to slide the tapered end 44 of a cylindrically shaped tool 46 along the inner cylindrical wall surface 48 of the fixture 40 from its solid line position to its dot dash line position or to the position where the stop portion 50 of the tool 46 is in engagement with the right end of the fixture 40.

The third step is to pull the tool 46 and fixture 40 in a left to right direction, as viewed in FIG. 1, out of contact with the pin 16 and cup 14 and thereby cause the bored out wall portion 38 of the sleeve 14 to slightly tilt both the then bent center pin 16 in a counterclockwise direction and the member 18, or base of the cup 14, into the crimped position shown for these elements in FIG. 3.

The bent tip of the free end of pin 16, made in the aforementioned manner, will be aligned for engagement with the sleeve 28 as the plug 10 is inserted, as shown in FIG. 3, into the open end of the socket 26.

As the plug 10 is moved from the position shown, for example in FIG. 3, into engagement with the socket 26, the resiliency of the bent center pin 16 will allow it to be deflected slightly and to be brought into good mating electrical contact with the inner surface of sleeve 28. Experimentation has shown that the action of continuously bringing the socket 26 into and out of electrical contact with the bent center pin 16 over long periods of service does not result in the previously-mentioned cold-flow failure of the bent member 18 as has been the case with the previously-mentioned prior art electrical P.C. plug type connectors that have plug and socket connections whose longitudinal axis are axially displaced from one another.

The reason why this contact failure problem is eliminated is because the bent pin 16 and its bent member 18 that is employed in the present invention allows the pin 16 and the bent member 18 to flex without introducing undesired stresses in the pin 16 and/or cold flow in the member 18.

A sturdy electrical connector 10, known in the art as a P.C. connector, having a characterized bend formed in an outer free end portion of its center pin 16 as described herein will thus provide a structure that insures good, reliable electrical mating contact with its associated socket over long periods of service.

The embodiments of the invention in which an exclusive property or privilege is claimed are defined as follows:

1. A means for bending the outer end portion of a center pin of a P.C. plug having a cup-shaped member with an inner wall around and spaced from the center pin, comprising a sleeve-shaped fixture having a restricted end wall portion mounted for simultaneous slidable movement along the inner wall of the cup-shaped member of said plug and along the outer end portion of said center pin, a cylindrical shaped tool having a tapered end for inserting between an inner wall portion of said sleeve-shaped fixture and an outer surface of the outer end portion of said center pin that extends into said sleeve-shaped fixture to thereby effect the bending of said outer end portion of said pin, and said restricted end wall portion of said sleeve-shaped fixture being movable into engagement with said bent portion of said pin to tilt said pin as said fixture is slid along and off the outer end of said pin.

2. The means for bending the center pin as defined in claim 1 wherein the said movement of said sleeve-shaped fixture toward the said outer end of said center pin causes its restricted end wall portion to partially tilt said bent end of said center pin in a direction towards its unbent position and to simultaneously form a crimp in a base portion of said cup member on which a fixed end of the pin is mounted.

3. The means for bending the center pin as defined in claim 1 wherein a shoulder portion formed on the sleeve-shaped fixture comprises means to engage the wall forming the open end portion of said cup-shaped member and to thereby limit the inward movement of the fixture into said cup-shaped member to a predetermined longitudinal position on the center pin.

* * * * *